US008493299B2

(12) United States Patent
Shiomi et al.

(10) Patent No.: US 8,493,299 B2
(45) Date of Patent: Jul. 23, 2013

(54) IMAGE DATA PROCESSING DEVICE, LIQUID CRYSTAL DISPLAY APPARATUS INCLUDING SAME, DISPLAY APPARATUS DRIVING DEVICE, DISPLAY APPARATUS DRIVING METHOD, PROGRAM THEREFOR, AND STORAGE MEDIUM

(75) Inventors: Makoto Shiomi, Tenri (JP); Mitsuhiro Shigeta, Uji (JP); Kazunari Tomizawa, Kizugawa (JP)

(73) Assignee: Sharp Kabushiki Kaisha, Osaka (JP)

( * ) Notice: Subject to any disclaimer, the term of this patent is extended or adjusted under 35 U.S.C. 154(b) by 1541 days.

(21) Appl. No.: 11/792,590

(22) PCT Filed: Dec. 8, 2005

(86) PCT No.: PCT/JP2005/022553

§ 371 (c)(1), (2), (4) Date: Jun. 8, 2007

(87) PCT Pub. No.: WO2006/062159

PCT Pub. Date: Jun. 15, 2006

(65) Prior Publication Data

US 2008/0043027 A1 Feb. 21, 2008

(30) Foreign Application Priority Data

Dec. 9, 2004 (JP) ..... 2004-357405

(51) Int. Cl.
*G09G 3/30* (2006.01)

(52) U.S. Cl.
USPC ..... 345/87

(58) Field of Classification Search
USPC ..... 345/89, 98, 100, 101, 690
See application file for complete search history.

(56) References Cited

U.S. PATENT DOCUMENTS 5,347,294 A * 9/1994 Usui et al. ..... 345/89
7,342,564 B2 * 3/2008 Ham et al. ..... 345/98

(Continued)

FOREIGN PATENT DOCUMENTS

EP 1 465 149 A2 4/2004
JP 10-039837 2/1998
JP 2003-36055 2/2003

(Continued)

*Primary Examiner* — Joseph Haley
(74) *Attorney, Agent, or Firm* — Harness, Dickey & Pierce, P.L.C.

(57) ABSTRACT

In cases where the amount of gradation transition is greater than a threshold value, a modulation processing section corrects image data D of a current frame by making an interpolation calculation with reference to a look-up table, and output the image data D thus corrected. In cases where the amount of gradation transition is not more than the threshold value, the modulation processing section directly outputs the image data D of the current frame. Furthermore, in one embodiment of the present invention, the look-up table contains, as output image data D2 corresponding to a case where the image data D of the current frame is identical to image data D0 of a previous frame, a value which is neither of the image data D of the current frame and the image data D0 of the previous frame and by which output image data D2 corresponding to the inputted image data D and D0 of the previous and current frames is calculated according to the interpolation calculation in cases where the amount of gradation transition is greater than the threshold value. With this, an image display apparatus is realized which can be balanced between a reduction in circuit size and an improvement in display quality at a higher level.

8 Claims, 9 Drawing Sheets

| S \ E | 0 | 32 | 64 | 96 | 128 | 160 | 192 | 224 | 255 |
|---|---|---|---|---|---|---|---|---|---|
| 0 | V(0) | 35 | 63 | 93 | 123 | 155 | 176 | 192 | 194 |
| 32 | 26 | V(32) | 63 | 94 | 125 | 157 | 189 | 223 | 239 |
| 64 | 42 | 42 | V(64) | 95 | 126 | 157 | 188 | 224 | 246 |
| 96 | 56 | 56 | 65 | V(96) | 127 | 159 | 190 | 224 | 249 |
| 128 | 64 | 64 | 64 | 96 | V(128) | 158 | 190 | 223 | 251 |
| 160 | 76 | 76 | 76 | 97 | 128 | V(160) | 191 | 225 | 253 |
| 192 | 90 | 90 | 90 | 99 | 128 | 160 | V(192) | 224 | 254 |
| 224 | 112 | 112 | 112 | 112 | 129 | 160 | 191 | V(224) | 254 |
| 255 | 134 | 134 | 134 | 134 | 134 | 159 | 192 | 223 | V(255) |

U.S. PATENT DOCUMENTS

| | | | | |
|---|---|---|---|---|
| 7,405,741 | B1 * | 7/2008 | Zhang et al. | 345/690 |
| 7,427,993 | B1 * | 9/2008 | Zhang et al. | 345/600 |
| 7,436,382 | B2 * | 10/2008 | Okuda et al. | 345/89 |
| 7,443,370 | B1 * | 10/2008 | Zhang et al. | 345/87 |
| 7,522,138 | B2 * | 4/2009 | Lee et al. | 345/89 |
| 2001/0038372 | A1 * | 11/2001 | Lee | 345/89 |
| 2002/0033789 | A1 * | 3/2002 | Miyata et al. | 345/89 |
| 2002/0044115 | A1 * | 4/2002 | Jinda et al. | 345/87 |
| 2002/0050965 | A1 * | 5/2002 | Oda et al. | 345/87 |
| 2002/0140652 | A1 * | 10/2002 | Suzuki et al. | 345/87 |
| 2003/0033789 | A1 | 2/2003 | Harrison et al. | |
| 2003/0048245 | A1 * | 3/2003 | Ham | 345/87 |
| 2003/0179175 | A1 * | 9/2003 | Shigeta et al. | 345/101 |
| 2004/0135800 | A1 * | 7/2004 | Shiomi et al. | 345/691 |
| 2004/0196234 | A1 * | 10/2004 | Shiomi et al. | 345/89 |
| 2004/0207588 | A1 * | 10/2004 | Shiomi | 345/87 |

FOREIGN PATENT DOCUMENTS

| | | |
|---|---|---|
| JP | 2004-4629 | 1/2004 |
| JP | 2004-220022 | 8/2004 |
| JP | 2004-318131 | 11/2004 |

* cited by examiner

FIG. 5

| S \ E | 0 | 32 | 64 | 96 | 128 | 160 | 192 | 224 | 255 |
|---|---|---|---|---|---|---|---|---|---|
| 0 | V(0) | 35 | 63 | 93 | 123 | 155 | 176 | 192 | 194 |
| 32 | 26 | V(32) | 63 | 94 | 125 | 157 | 189 | 223 | 239 |
| 64 | 42 | 42 | V(64) | 95 | 126 | 157 | 188 | 224 | 246 |
| 96 | 56 | 56 | 65 | V(96) | 127 | 159 | 190 | 224 | 249 |
| 128 | 64 | 64 | 64 | 96 | V(128) | 158 | 190 | 223 | 251 |
| 160 | 76 | 76 | 76 | 97 | 128 | V(160) | 191 | 225 | 253 |
| 192 | 90 | 90 | 90 | 99 | 128 | 160 | V(192) | 224 | 254 |
| 224 | 112 | 112 | 112 | 112 | 129 | 160 | 191 | V(224) | 254 |
| 255 | 134 | 134 | 134 | 134 | 134 | 159 | 192 | 223 | V(255) |

FIG. 7

| S \ E | 0 | 32 | 64 | 96 | 128 | 160 | 192 | 224 | 255 |
|---|---|---|---|---|---|---|---|---|---|
| 0 | V2a (0) / V1a (0) | 35 | 63 | 93 | 123 | 155 | 176 | 192 | 194 |
| 32 | 26 | V2a (32) / V1a (32) | 63 | 94 | 125 | 157 | 189 | 223 | 239 |
| 64 | 42 | 42 | V2a (64) / V1a (64) | 95 | 126 | 157 | 188 | 224 | 246 |
| 96 | 56 | 56 | 65 | V2a (96) / V1a (96) | 127 | 159 | 190 | 224 | 249 |
| 128 | 64 | 64 | 64 | 96 | V2a (128) / V1a (128) | 158 | 190 | 223 | 251 |
| 160 | 76 | 76 | 76 | 97 | 128 | V2a (160) / V1a (160) | 191 | 225 | 253 |
| 192 | 90 | 90 | 90 | 99 | 128 | 160 | V2a (192) / V1a (192) | 224 | 254 |
| 224 | 112 | 112 | 112 | 112 | 129 | 160 | 191 | V2a (224) / V1a (224) | 254 |
| 255 | 134 | 134 | 134 | 134 | 134 | 159 | 192 | 223 | V2a (255) / V1a (255) |

IMAGE DATA PROCESSING DEVICE, LIQUID CRYSTAL DISPLAY APPARATUS INCLUDING SAME, DISPLAY APPARATUS DRIVING DEVICE, DISPLAY APPARATUS DRIVING METHOD, PROGRAM THEREFOR, AND STORAGE MEDIUM

TECHNICAL FIELD

The present invention relates to an image data processing device that processes image data indicating a gradation of a pixel, a liquid crystal display apparatus including the image data processing device, a display apparatus driving device, a display apparatus driving method, a program therefore, and a storage medium, each of which makes it possible to achieve a balance between a reduction in circuit size and an improvement in display quality at a higher level.

BACKGROUND ART

Liquid crystal display apparatuses have space-saving and power-saving features. In addition, liquid crystal display apparatuses have been recently improved in performance such as viewing angle, contrast, color reproducibility, response speed, and the like. This has caused liquid crystal display apparatuses to outperform cathode-ray tubes. Therefore, it is predicted that liquid crystal display apparatuses will be applied more and more widely to televisions and OA monitors (computer monitors) in the future.

Normally, when a voltage is applied to a liquid crystal cell, the long axis direction (director) of liquid crystal material (liquid crystal molecules) contained in the liquid crystal cell is changed due to the dielectric anisotropy of the liquid crystal material. The liquid crystal material has optical anisotropy. Therefore, a change in direction of the liquid crystal material causes a change in direction of polarization of light passing through the liquid crystal cell. Moreover, with the functions of a polarization plate and other members that are provided in the liquid crystal cell function, the amount of light that passes through the liquid crystal cell is controlled in accordance with an applied voltage applied to the liquid crystal cell (applied voltage). This makes it possible to set the luminance of each pixel to a desired gradation luminance, thereby making it possible to display an image.

However, it takes a certain amount of time for the liquid crystal material to respond to a change in applied voltage (the liquid crystal material has a low response speed). For example, in case of a currently widely used liquid crystal display method (liquid crystal display mode) such as TN (Twisted Nematic), IPN (In-Plane-Switching), or VA (Vertically Aligned), the liquid crystal material has a response speed of 30 msec to 50 msec between slow gradations. This makes it impossible to realize a response speed that corresponds to 60 Hz (approximately 16.6 msec) of NTSC (National Television System Committee) signal or 50 Hz (approximately 20.0 msec) of PAL (Phase Alternation by Line). In order to meet the requirements of further market expansion, higher performance is required.

In view of this, conventionally, a liquid crystal display apparatus has been being developed whose response speed is increased by elaborating liquid crystal material and a method for driving a display.

For example, Patent Document 1 (Japanese Unexamined Patent Publication No. 39837/1998 (Tokukaihei 10-39837; published on Feb. 13, 1998)) discloses a liquid crystal display apparatus using "overshoot driving". According to the liquid crystal display apparatus, a voltage greater than a voltage difference corresponding a change in gradation is applied so that the liquid crystal material is rapidly moved to a target gradation. According to the overshoot driving, a look-up table (LUT) is prepared in advance in which an applied gradation value (or an applied voltage value that realizes the applied gradation) to be applied to the liquid crystal material is set in association with an initial gradation (current gradation) and a target gradation (desired gradation), and a voltage is applied in accordance with the LUT.

However, an attempt to prepare an LUT in which values corresponding to applied voltage values corresponding to all patterns of gradation change are stored causes such a problem that a memory is required to have extremely large capacity to store the LUT.

In order to solve this problem, Patent Document 2 (Japanese Unexamined Patent Application No. 4629/2004 (Tokukai 2004-4629; published on Jan. 8, 2004) discloses a liquid crystal display apparatus. As shown in FIG. 9, the liquid crystal display apparatus includes an applied gradation value acquisition section 113 which receives previous gradation data, subsequent gradation data, and measurement data sent from a temperature sensor 108, and which, by making an interpolation calculation with reference to a plurality of LUTs stored in an LUT memory 112, calculates gradation data necessary for gradation display as target gradation data. This arrangement makes it possible that high-precision target gradation data (interpolated value) can be found, in consideration of various additional conditions, by interpolation calculation using a local coordinate.

However, whereas the arrangement of Patent Document 2 achieves a larger reduction in circuit size than the arrangement in which all the patterns are stored, the arrangement of Patent Document 2 suffers from a certain level of deterioration in display quality due to interpolation calculation as compared with the arrangement in which all the patterns are stored. This has made it necessary to further improve display quality so as not to cause a great increase in circuit size.

DISCLOSURE OF INVENTION

It is an object of the present invention to realize a display apparatus that is balanced between a reduction in circuit size and an improvement in display quality at a higher level.

In order to attain the foregoing object, an image data processing device according to the present invention is an image data processing device, including: an image data storage device in which image data, being repeatedly inputted, which indicates a gradation of a pixel is stored until next image data; and correction means capable of outputting, in accordance with previous image data and current image data that has been read out from the image data storage section, corrected image data corrected so that a gradation transition from a gradation indicated by the previous image data to a gradation indicated by the current image data is emphasized, the correction means including: a parameter storage device which, in correspondence with predetermined part of combinations of possible values of the previous image data and possible values of the current image data, contains parameters for determining corrected image data corresponding to the predetermined combinations, respectively; and interpolation means (i) for, when a difference between the gradations respectively indicated by the previous and current image data inputted thereto is more than a predetermined threshold value and when a parameter corresponding to an input combination of a value of the previous and a value of the current image data is not stored in the parameter storage device, (a) reading out a plurality of parameters from the parameter storage device, (b) calculating a parameter corresponding to the input combination by making an interpolation calculation that is based on the plurality of parameters, and (c) generating the corrected image data, and (ii) for outputting the current image data without correction when the difference between the gradations respectively indicated by the previous and current image data inputted thereto is not more than the threshold value, the parameter storage device containing, as a parameter corresponding to a specific one of the predetermined combinations which is constituted by values indicating an identical gradation, a parameter which is such that a gradation indicated by corrected image data determined by the parameter is neither of gradations respectively indicated by the values constituting the specific combination and by which a parameter corresponding to the specific combination is calculated according to the interpolation calculation when a difference between gradations respectively indicated by the values constituting the input combination is more than the threshold value.

According to this arrangement, in cases where the difference between the gradations respectively indicated by the inputted image data is more than a predetermined threshold value, the image data processing device can output corrected image data by which the gradation transition is emphasized. This makes it possible to improve the response speed of a pixel of a display apparatus by which image data is displayed.

Further, in cases where the amount of gradation transition is not more than the threshold value, the correction means does not emphasize the gradation transition. This makes it possible to prevent the following problem: In case where a still image is displayed, a slight gradation transition occurring due to the influence of noise or the like is emphasized, so that an undesired gradation transition is seen by the user.

Furthermore, the parameter storage device contains only parameters corresponding to part of combinations of respective possible values of the current and previous image data, and parameters corresponding to the rest of the combinations are calculated by interpolation calculation. This makes it possible to achieve a larger reduction in circuit size than when the parameter storage device contains parameters corresponding to all the combinations.

Further, the parameter storage device contains a parameter in correspondence with the specific combination, i.e., a parameter which is such that a gradation indicated by corrected image data determined by the parameter is neither of gradations indicated by the values constituting the specific combination and by which a parameter corresponding to the specific combination is calculated according to the interpolation calculation when a difference between gradations respectively indicated by the values constituting the input combination is more than the threshold value. Therefore, as compared with an arrangement in which either of the gradations respectively indicated by the values constituting the specific combination is stored in correspondence with the specific combination by which no gradation transition occurs, it is possible to achieve a reduction in error attributed to an approximation made with the use of interpolation calculation, and to improve the quality of a display carried out by a display apparatus.

This makes it possible to realize a display apparatus that is balanced between a reduction in circuit size and an improvement in display quality at a higher level.

In cases where such a parameter is stored in correspondence with the specific combination, the use of interpolation calculation at the time when the amount of gradation transition is not more than the threshold value may cause an increase in error attributed to an approximation made with the use of interpolation calculation. However, the correction means does not emphasize the gradation transition in cases where the amount of gradation transition is not more than the threshold value. Therefore, no such error occurs in cases where the amount of gradation transition is not more than the threshold value. This makes it possible to prevent display quality from deteriorating due to such an error.

Further, in order to attain the foregoing object, a display apparatus driving device according to the present invention is a display apparatus driving device, including: correction means for correcting image data, being inputted repeatedly, which indicates a gradation of a pixel, and for outputting the image data thus corrected; and output means for outputting, to a data signal line connected to the pixel, a signal corresponding to the image data thus corrected, the uncorrected image data being inputted repeatedly being D(n−1) and D(n), the corrected image data respectively corresponding to the uncorrected image data being D2(*n*−1) and D2(*n*), when an amount of gradation transition of the uncorrected image data is greater than a predetermined threshold value L, the correction means outputting D2(*n*)=a+k·[D(n−1)−D(n)] as the corrected image data D2(*n*), when the amount of gradation transition of the uncorrected image data is less than the threshold value L, the correction means outputting D2(*n*)=D(n) as the corrected data D2(*n*), a being set to be a value that is different from D(n).

According to this arrangement, D2(*n*)=a+k·[D(n−1)−D(n)] is outputted as the corrected image data D2(*n*) when the amount of gradation transition of the uncorrected image data is greater than a predetermined threshold value L, and D2(*n*)=D(n) is outputted as the corrected image data D2(*n*) when the amount of gradation transition is less than the threshold value L. Further, a is set to be a value that is different from D(n).

Therefore, as with the image data processing device, it is possible to achieve a reduction in error attributed to an approximation made with the use of interpolation calculation, and to improve the quality of a display carried out be a display apparatus, as compared with an arrangement in which either of the gradations respectively indicated by the values constituting the specific combination is stored in correspondence with the specific combination by which no gradation transition occurs. This makes it possible to realize a display apparatus that is balanced between a reduction in circuit size and an improvement in display quality at a higher level.

Additional objects, features, and strengths of the present invention will be made clear by the description below. Further, the advantages of the present invention will be evident from the following explanation in reference to the drawings.

BRIEF DESCRIPTION OF DRAWINGS

FIG. 5 is a diagram showing a combination of image data of the previous frame and image data of the current frame, the corresponding output image data of which combination is stored in the look-up table.

FIG. 7 shows another embodiment of the present invention, and is a diagram showing output image data stored in a look-up table of the modulation driving processing section.

REFERENCE NUMERALS

1, 1*a*, 1*b* Image display apparatus (liquid crystal display apparatus)

21, 21*a*, 21*b* Modulation driving processing section (image data processing device)

31 Frame memory (image data storage device)

35, 35*a* Look-up table (parameter storage device)

34, 34*a*, 34*b* Modulation processing section (interpolation means)

V Value of image data (parameter)

V1, V2 Value of image data (first and second parameters)

V1, V2*a* Difference value of image data (first and second parameters)

BEST MODE FOR CARRYING OUT THE INVENTION

[Embodiment 1]

An embodiment of the present invention will be described below with reference to FIGS. 1 through 6. That is, an image display apparatus according to the present invention is an image display apparatus which, in cases where the amount of gradation transition from the previous gradation to the current gradation is greater than a predetermined threshold value, emphasizes the gradation transition by interpolating a value stored in a look-up table (LUT), and which emphasizes the gradation transition in cases where the amount of gradation transition from the previous gradation to the current gradation is not more than the predetermined threshold value, and allows more appropriate interpolation without causing an increase in circuit size of the look-up table.

Figure 2:
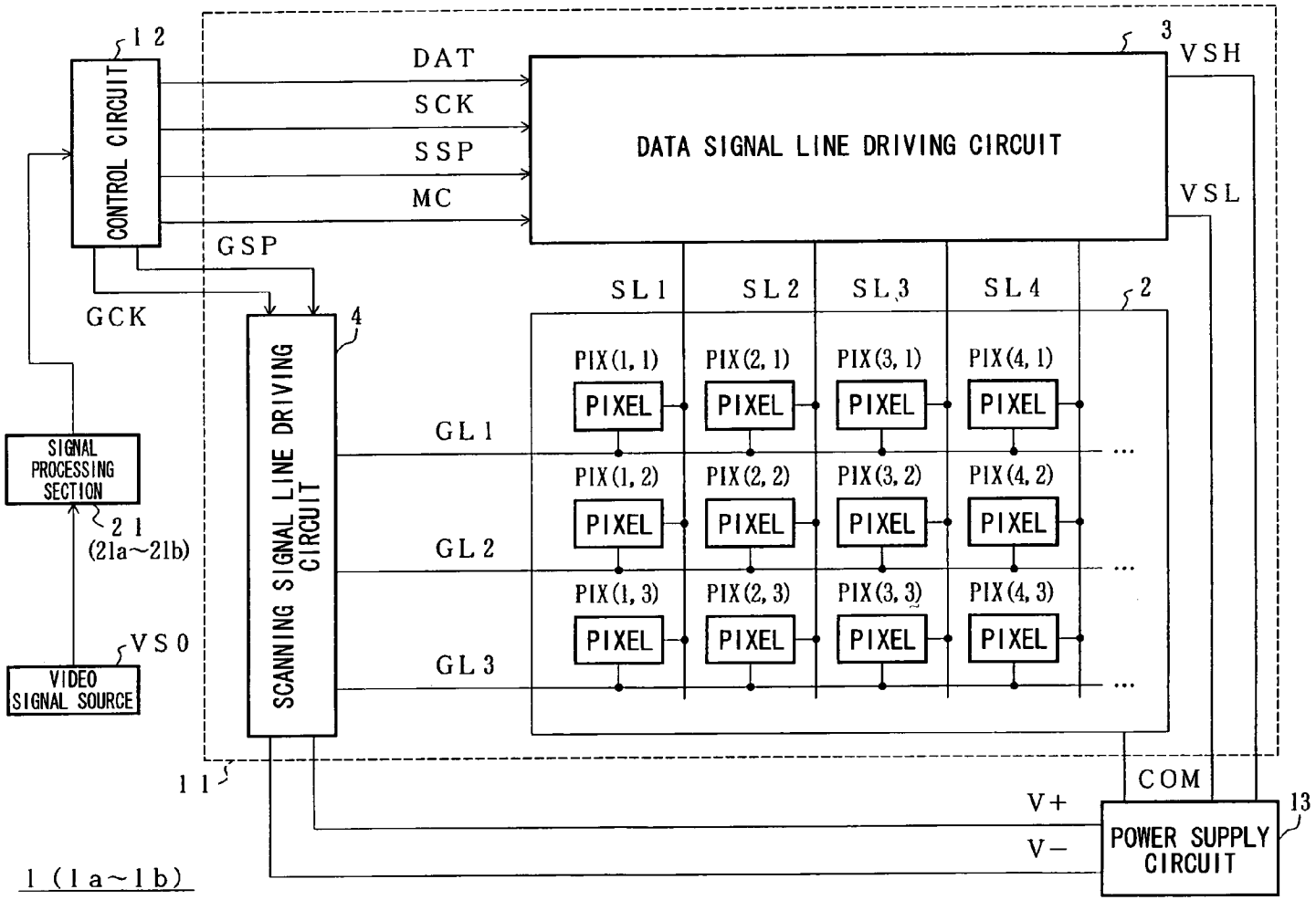
FIG. 2 is a block diagram showing a structure of a main part of an image display apparatus including the modulation driving processing section.

As shown in FIG. 2, the image display apparatus 1 has a panel 11 which includes a pixel array 2 having pixels PIX(1, 1) to PIX(n,m) disposed in a matrix manner, a data signal line driving circuit 3 for driving data signal lines SL1 to SLn of the pixel array 2, and a scanning signal line driving circuit 4 for driving scanning signal lines GL1 to GLm of the pixel array 2. Further, the image display apparatus 1 includes a control circuit 12 for supplying control signals to both of the driving circuits 3 and 4 and a modulation driving processing section (image data processing section) 21 which, in accordance with a video signal inputted thereto, modulates and supplies the video signal to the control circuit 12 so that the gradation transition is emphasized. Note that these circuits operate on power supplied from a power supply circuit 13.

In the following, the image display apparatus (liquid crystal display apparatus) 1 are schematically described as a whole in terms of structure and operation before the modulation driving processing section 21 serving as a display apparatus driving device is fully described in terms of structure. Further, for convenience of explanation, only in cases where the location of a member needs to be specified is the member given a number or alphabet character indicative of the location of the member (e.g., "the ith data signal line SLi"). In cases where the location of the member does not need to be specified or in cases where the member is generally referred to, the member is not given a character indicative of the location of the member.

The pixel array 2 includes a plurality of data signal lines (n data signal lines in this case) SL1 to SLn and a plurality of scanning signal lines (m data signal lines in this case) GL1 to GLm each crossing each of the data signal lines SL1 to SLn. Assuming that i is an arbitrary integer of 1 to n and j is an arbitrary integer of 1 to m, each combination of a data signal line SLi and a scanning signal line GLj is provided with a pixel PIX(i,j). In the present embodiment, each pixel PIX(i,j) is disposed in an area surrounded by two adjacent data signal lines SL(i−1) and SLi and two adjacent scanning signal lines GL(j−1) and GLj.

Figure 3:
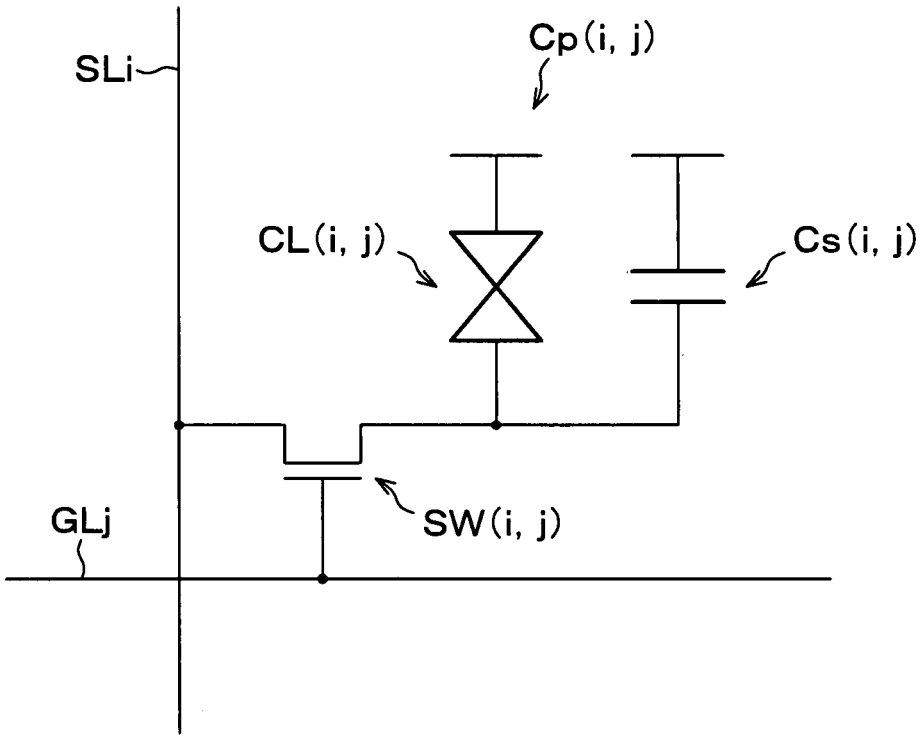
FIG. 3 is a circuit diagram showing an example of a structure of a pixel of the image display apparatus.

The image display apparatus 1 according to the present invention is a liquid crystal display apparatus. For example, as shown in FIG. 3, the pixel PIX(i.j) includes (i) a field-effect transistor SW(i,j), serving as a switching element, whose gate is connected to the scanning signal line GLj and whose drain is connected to the data signal line SLi and (ii) a pixel capacitor Cp(i,j) having one electrode connected to a source of the field-effect transistor SW(i,j). Further, the other end of the pixel capacitor Cp(i,j) is connected to a common electrode line common to all the pixels PIX . . . The pixel capacitor Cp(i,j) includes a liquid crystal capacitor CL(i,j) and a supplementary capacitor Cs(i,j) that is to be added as required.

According to the pixel PIX(i,j), when the scanning signal line GLj is selected, the field-effect transistor SW(i,j) becomes conductive, so that a voltage applied to the data signal line SLi is applied to the pixel capacitor Cp(i,j). On the other hand, when the select period of the scanning signal line GLi ends, the field-effect transistor SW(i,j) is turned off. While the field-effect transistor is off, the pixel capacitor Cp(i,j) continues to retain the voltage applied thereto when the field-effect transistor SW(i,j) was turned off. The transmittance or reflectance of liquid crystals is changed depending on a voltage applied to the liquid crystal capacitor CL(i,j). Therefore, when the scanning signal line GLj is selected and a voltage corresponding to image data D to be sent to the pixel PIX(i,j) is applied to the data signal line SLi, a display state of the pixel PIX(i,j) can be changed in accordance with the image data D.

The image display apparatus 1 according to the present embodiment uses a homeotropic-mode liquid-crystal cell as a liquid crystal cell for use in the pixel array 2. That is, according to the liquid crystal cell, liquid crystal molecules are aligned substantially perpendicularly to the substrate when no voltage is applied, and are tilted out of the homeotropic alignment in accordance with the voltage applied to the liquid crystal capacitor CL(i,j) of the pixel PIX(i,j). The liquid crystal cell is used in a normally black mode (a mode in which a black display is carried out when no voltage is applied).

According to the foregoing arrangement, the scanning signal line driving circuit 4 shown in FIG. 2 sends, to each of the scanning signal lines GL1 to GLm, a signal, such as a voltage signal, which indicates whether or not the scanning signal line GLj is in a select period. Further, the scanning signal lines driving circuit 4 selects, in accordance with a timing signal, such as a clock signal GCK or a start pulse signal GSP, which is supplied from the control circuit 12, a scanning signal line GLj to which a signal indicative of a select period is to be sent. With this, the scanning signal lines GL1 to GLm are sequentially switched over to one another at a predetermined timing.

Furthermore, for example, the data signal line driving circuit 3 samples, at a predetermined timing, image data D . . . to be respectively inputted as a video signal DAT to the pixels PIX . . . in a time-sharing manner, thereby extracting the image data D. Furthermore, the data signal lines driving device 3 outputs signals corresponding to the image data D . . . to be respectively inputted to the pixels PIX. The signals thus outputted are sent, via the data signal lines SL1 to SLn, to the pixels PIX(1,j) to PIX(n,j) corresponding to the scanning signal line GLj currently selected by the scanning signal line driving circuit 4, respectively.

The data signal line driving circuit 3 determines, in accordance with a timing signal, such as a clock signal SCK or a start pulse signal SSP, which is supplied from the control circuit 12, a timing at which the sampling is carried out and timings at which the signals are outputted.

Meanwhile, the brightness of each of the pixels PIX(1,j) to PIX(n,j) is determined in the following manner. That is, while scanning signal lines GLj respectively corresponding to the pixels PIX(1,j) to PIX(n,j) are being selected, the transmittance or the like of each of the pixels PIX(1,j) to PIX(n,j) is adjusted in accordance with an output signal supplied to the data signal lines SL1 to SLn respectively corresponding to the pixels PIX(1,j) to PIX(n,j).

Here, the scanning signal line driving circuit 4 sequentially selects the scanning signal lines GL1 to GLm. Therefore, each of the pixels PIX(1,1)~PIX(n,m) of the pixel array 2 can be set to have the brightness (gradation) indicated by the image data D to be respectively inputted to the pixels PIX(1,1)~PIX(n,m) so that an image to be displayed by the pixels array 2 can be updated.

The image data D may be a gradation level as long as it can specify a gradation level of the pixel PIX(i,j), or may be a parameter by which a gradation level is calculated. However, the following description assumes, for example, that the image data is a gradation level of the pixel PIX(i,j).

Further, in the image display apparatus 1, a video signal DAT supplied from a video signal source VS0 to the modulation driving processing section 21 may be transmitted in units of frames (in units of full screens), or may be transmitted in units of fields into which a single frame has been divided. The following description assumes, for example, that the video signal DAT is transmitted in units of fields.

That is, in the present embodiment, the video signal DAT, supplied from the video signal source VS0 to the modulation driving processing section 21, is transmitted in units of a plurality of fields (e.g., two fields) into which a single frame has been divided.

More specifically, in transmitting the video signal DAT to the modulation driving processing section 21 of the liquid crystal display apparatus 1 via a video signal line VL, the video signal source VS0 transmits the entire image data for a given field, and then transmits image data for the next field, for example. Thus, the video signal source VS0 transmits image data for respective fields in a time-sharing manner.

The field is constituted by a plurality of horizontal lines. For example, in a given field, via the video signal line VL, entire image data for a given horizontal line are transmitted and then image data for a horizontal line to be transmitted next are transmitted. Thus, the image data for the respective horizontal lines are transmitted in a time-sharing manner.

In the present embodiment, a single frame is constituted by two fields. Among the horizontal lines constituting a single frame, image data of an even-numbered horizontal line is transmitted in an even-numbered field. Image data of an odd-numbered horizontal line is transmitted in an odd-numbered field. Further, also in transmitting image data corresponding to a single horizontal line, the image signal source VS0 drives the image signal line VL in a time-sharing manner. This allows the respective image data to be sequentially transmitted in a predetermined order.

Figure 1:
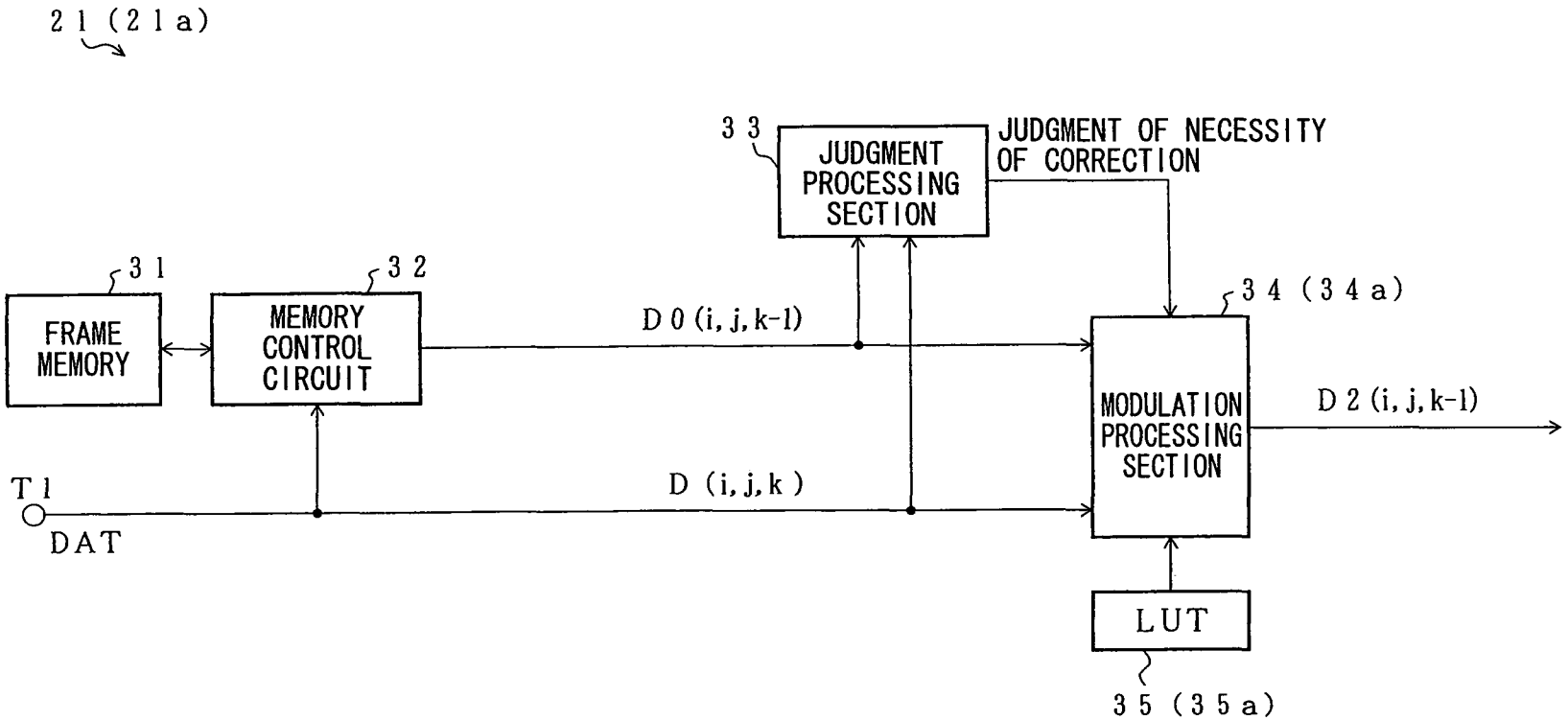
FIG. 1 shows an embodiment of the present invention, and is a block diagram showing a structure of a main part of a modulation driving processing section.

As shown in FIG. 1, the modulation driving processing section 21 according to the present embodiment includes: a frame memory (image data storage device) 31, in which image data corresponding to one frame is stored until a next frame; a memory control circuit 32, which basically writes image data D(i,j,k) of a current frame FR(k) in the frame memory 31, the image data D(i,j,k) having been inputted to an input terminal T1 and reads out image data D0(*i,j,k*−1) of a previous frame FR(k−1) from the frame memory 31 and outputs the image data D0(*i,j,k*−1); a judgment processing section 33, which judges, in accordance with the image data D(i,j,k) and D0(*i,j,k*−1), whether or not it is necessary to emphasize a gradation transition; a modulation processing section (interpolation means) 34, which, in cases where it is necessary to emphasize a gradation transition, corrects and outputs the image data D(i,j,k) of the current frame FR(k) so as to emphasize a gradation transition from the current frame FR(k) to the previous frame FR(k−1) in a pixel PIX(i,j), and which outputs the image data D(i,j,k) without correction in cases where it is not necessary to emphasize a gradation transition; and a look-up table (LUT; parameter storage device) 35, which is to be referred to when the modulation processing section 34 makes a correction.

In the following, regardless of whether or not a correction is made, a signal from the modulation processing section 34 is referred to as "output video signal DAT2", and data, contained in output image data D2 constituting the output video signal DAT2, which corresponds to the image data D(i,j,k) and D0(*i,j,k*−1) is referred to as "output image data D2(*i*,j,k). Further, regardless of whether or not the parts of the image display apparatus 1 have their respective signals, data, voltages, or luminances at the same time, a voltage to be applied to the pixel PIX(i,j) in accordance with the output image data D2(*i*,j,k), a frame to which the voltage is to be applied, and a luminance that the pixel PIX(i,j) reaches at the end of the current frame FR(k) in accordance with the voltage are referred to as "voltage of the current frame FR(k)", "current frame FR(k)", and "luminance of the current frame FR(k)", respectively.

Basically, the LUT 35 contains corrected output image data D2 (*i,j,k*) that are to be outputted in cases where predetermined ones of combinations of possible values (gradations) of the image data D(i,j,k−1) of the previous frame FR(k−1) and possible values (gradations) of the image data D(i,j,k) of the current frame FR(k) are inputted, respectively. Here, it depends on the characteristics of the pixel array 2 what values are stored in the LUT 35. In the present embodiment, in cases where a voltage corresponding to the second gradation is applied to a PIX(i,j) having a luminance indicated by the first gradation, the pixel PIX(i,j) reaches, at the end of a frame to which the voltage has been applied, a luminance indicated by the third gradation. On this occasion, the LUT 35 basically contains data indicative of the second gradation in correspondence with a combination of the first gradation and the third gradation.

Figure 4:
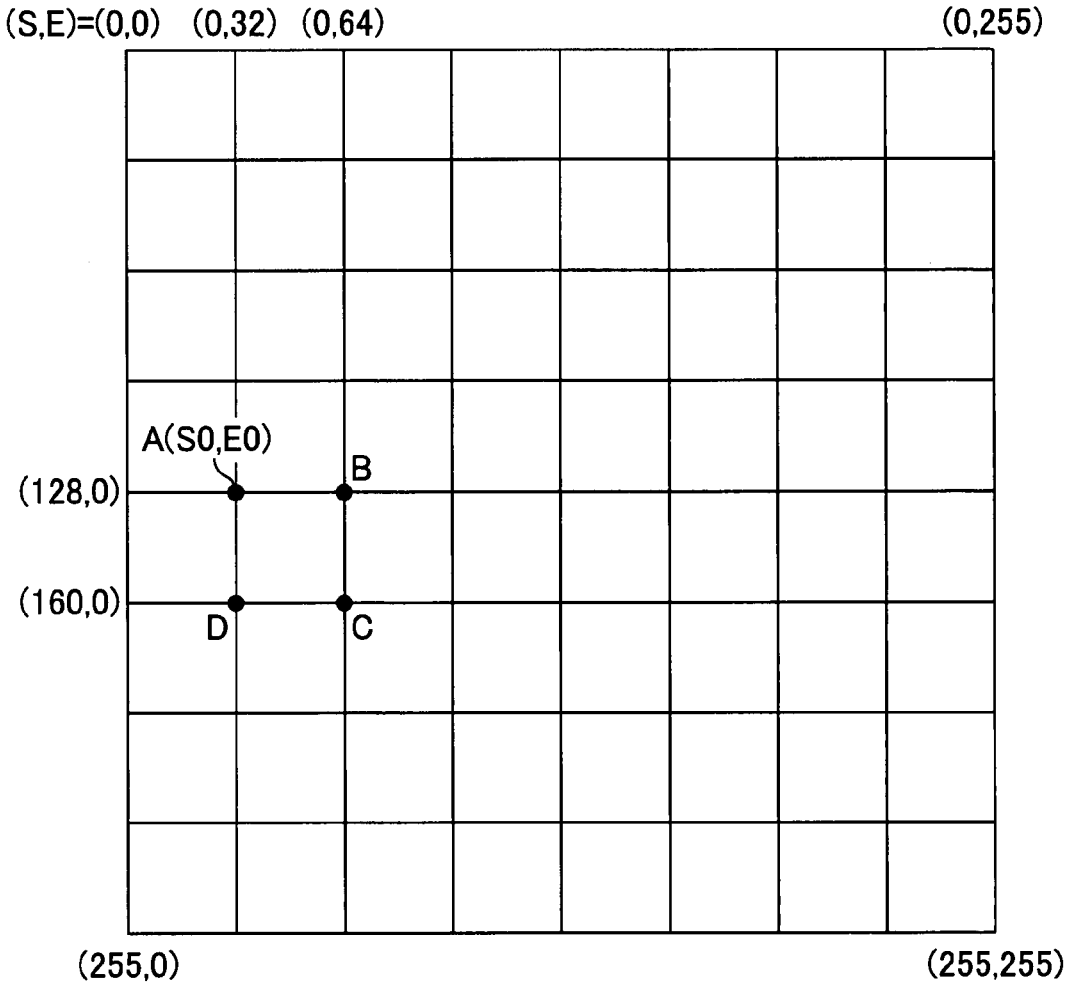
FIG. 4 is a diagram showing output image data stored in a look-up table of the modulation driving processing section.

For example, in the present embodiment, the possible values of the image data D0 of the previous frame and the possible values of the image data D of the current frame range from 0 to 255. When a region specified by the combinations of the possible values of the image data D0 of the previous frame and the possible values of the image data D of the current frame is divided into 8×8 small regions as shown in FIG. 4, the LUT 35 contains image data D2 corresponding to points respectively serving as four corners of each small region. In this example, the region is a two-dimensional space ranging from (0,0) to (255, 255). Therefore, when the region is divided into 8×8 small regions, each of the small regions is a region of 32 gradations×32 gradations. Therefore, in this case, the LUT 35 contains 9×9 points which are combinations of gradations at intervals of 32 gradations.

Further, in case where the judgment processing section 33 instructs the modulation processing section 34 to make a correction, the modulation processing section 34 can linearly interpolate the image data D2 respectively corresponding to the combinations stored in the LUT 35, thereby calculating and outputting image data D2 corresponding to a combination of a previous-frame representative value D0($i,j,k-1$) and image data D(i,j,k) which combination has been actually inputted to the modulation processing section 34.

More specifically, upon receiving the combination (S,E) of the image data D0($i,j,k-1$) and D(i,j,k), the modulation processing section 34 according to the present embodiment specifies which of the small regions each serving as a calculation area the combination belongs to. Furthermore, on the assumption that A, B, C, and D are the reached gradations of the upper left, upper right, lower right, and lower left corners of the calculation area, respectively, that Y×X is the amount of space occupied by the calculation area, and that (Δy,Δx)=((S−S0)/Y, (E−E0)/X) is a value obtained by normalizing the difference between the upper left combination (S0,E0) and the combination (S,E) to (1,1), in cases where Δx>=Δy, the arithmetic circuit 72 reads out the reached gradations A, B, and C from the LUT 35, and calculates D2($i$,j,k) according to Formula (1):

$$D2(i,j,k)=A+\Delta x\cdot(B-A)+\Delta y\cdot(C-B) \quad (1).$$

Meanwhile, in cases where Δx<Δy, the modulation processing section 34 reads out the reached gradations A, C, and D from the LUT 35, and calculates D2($i$,j,k) according to Formula (2):

$$D2(i,j,k)=C+\Delta x\cdot(C-D)+(1-\Delta y)\cdot(D-A) \quad (2).$$

For example, according to the example shown in FIGS. 4 and 5, in cases where (S,E) is (144,48), a calculation area surrounded by (128,32), (128,64), (160,64), and (160,32) is specified, so that the corrected image data D2($i$,j,k) is 60.

Figure 6:
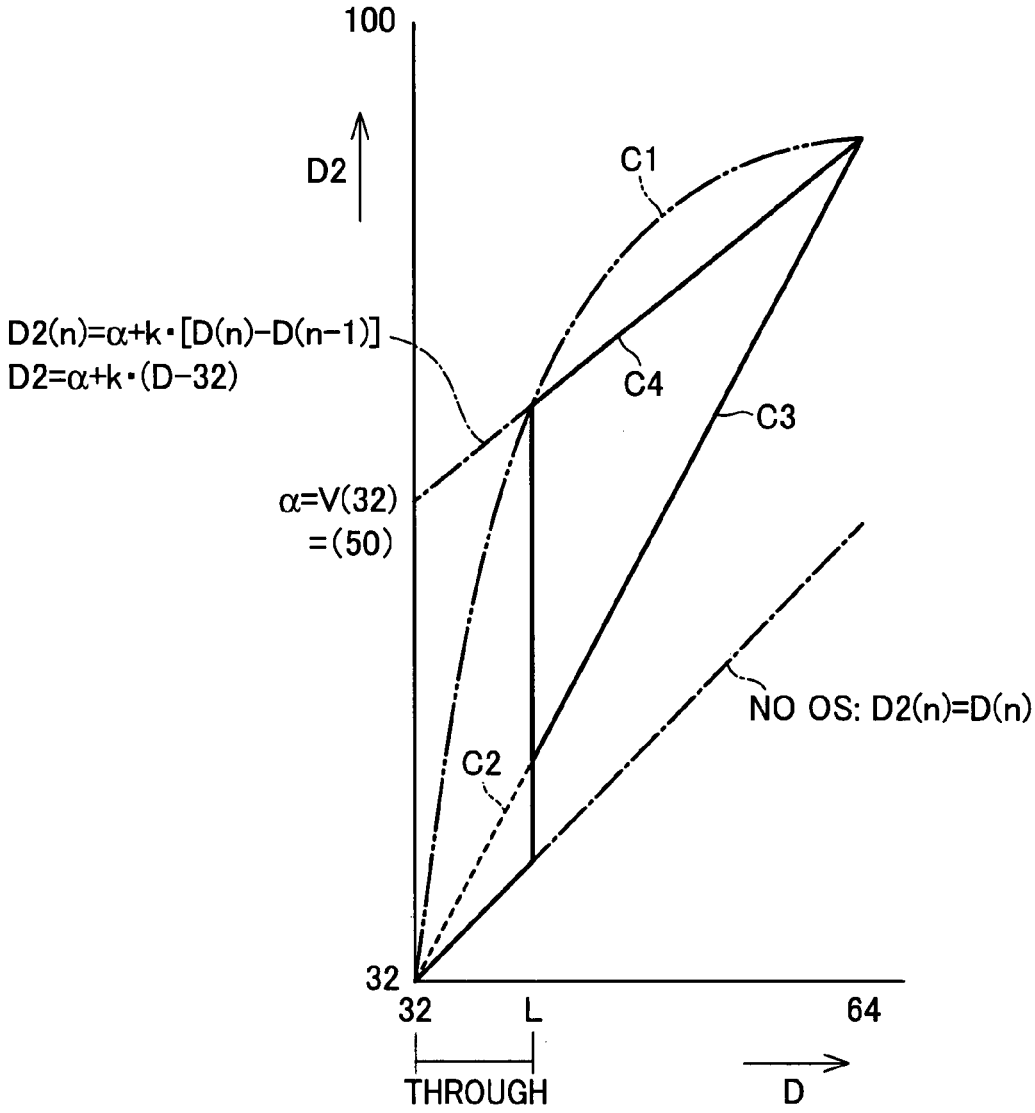
FIG. 6 is a graph showing a relationship between an ideal characteristic of the output image data and output image data generated by interpolation calculation.

As described above, the LUT 35 according to the present embodiment basically contains the data indicative of the second gradation in correspondence with the combination of the first gradation and the third gradation. However, by way of exception, in correspondence with a combination of gradations by which no gradation transition is caused (such a combination that the respective values of the image data D(i,j,k) and D0($i,j,k-1$) are identical to each other), the LUT 35 contains a value V that is greater than the value of the second gradation, instead of the value of the second gradation (the value of D(i,j,k)). The value V serves as a value set so as to minimize an error that occurs when image data D2 ($i,j,k$) in a range where a correction is made is calculated by interpolation calculation. Furthermore, in the present embodiment, the value V is more preferably set so as to minimize an error to the extent that no region of overcorrection appears in a range where a correction is made. In FIG. 6, V is followed by a value indicating the value of the image data D(i,j,k) of the current frame FR(k). For example, the value obtained in cases where the gradation indicated by the image data D(i,j,k) of the current frame FR(k) is 32 is V(32).

Furthermore, in case of a decay gradation transition and in cases where values to be read out from the LUT 35 include a value corresponding to a combination by which no gradation transition is caused (a combination by which D0=D), the modulation processing section 34 according to the present embodiment does not read out, from the LUT 35, the value corresponding to the combination. Instead, the modulation processing section 34 according to the present embodiment can calculates, by interpolation calculation using the image data D0 of the previous frame FR(k−1) or the image data D of the current frame FR(k), the value corresponding to the combination. Note that the case of a decay gradation transition refers to a case where a gradation transition causes a reduction in luminance, and to a case where the image data D of the current frame FR(k) is smaller than the image data D0 of the previous frame FR(k−1).

In the following, the values stored in the LUT 35 will be described with reference to FIG. 6. Here, an example of a small region having four corners one of which is a point at which no gradation transition occurs is a small region A1 whose four corners are respectively indicated by the (S,E) coordinates (0,32), (0,64), (32, 64), and (32, 32).

See the characteristic C1, shown in FIG. 6, which is indicated by a chain double-dashed curve. The characteristic C1 shows how the optimum image data D2 is changed in cases where only the image data D of the current frame FR(k) is changed so that the coordinates (32, 32) is changed to (32, 64). The horizontal axis represents S−E, and the vertical axis represents the value of the optimum image data D2. Note that the value of the optimum image data D2 can be determined in the same manner as the other aforementioned values stored in the LUT 35 (values by which no gradation transition is caused) are determined.

See Comparative Example 1, in which the LUT 35 contains the image data D of the current frame FR(k) in correspondence with a combination of gradations by which no gradation transition is caused, and in which the modulation processing section always performs linear interpolation. In such an arrangement, the image data D2 has a characteristic C2 indicated by a dotted line in FIG. 6.

See Comparative Example 2, in which, as with the modulation processing section 34 according to the present embodiment, gradation transition is not emphasized in cases where the amount of gradation transition (E−S) is less than a predetermined threshold value L. In such an arrangement, the image data D2 has a characteristic C3 indicated by a solid broken line in FIG. 6.

However, according to the arrangement of Comparative Example 2, the image data D of the current frame FR(k) is stored in correspondence with a combination of gradations by which no gradation transition is caused; therefore, in a place where S−E is greater than the threshold value L, the image data D2 to be outputted has a value that is far less than the aforementioned ideal characteristic C1.

On the other hand, the LUT 35 according to the present embodiment contains, in correspondence with a combination of gradations by which no gradation transition is caused, a value that is greater than the image data D of the current frame FR(k). Therefore, the modulation processing section 34 can output image data D2 having a characteristic C4 indicated by a solid broken line in FIG. 6.

More specifically, on the assumption that uncorrected image data are D(n−1) and D(n) and that corrected image data respectively corresponding thereto are D2($n-1$) and D2($n$), the characteristic C4 indicated by the broken line is D2($n$)=D(n) when the amount of gradation transition of the uncorrected image data is less than the threshold value L, and is D2($n$)=a+k·[(D(n)−D(n−1)] when the amount of gradation transition is greater than the threshold value L. According to the example shown in FIG. 6, D2($n$)=D2, D(n)=D, and D(n−

1)=32. Therefore, when the amount of gradation transition is greater than the threshold value L, D2=a+k·(D-32); and when the amount of gradation transition is less than the threshold value L, D2=D.

Here, in the present embodiment, a value that is greater than the image data D of the current frame FR(k) is stored in correspondence with a combination of gradations by which no gradation transition is caused. Therefore, as compared with the arrangement of Comparative Example 2, the image data D2 that has been subjected to liner interpolation has a greater value. Therefore, the modulation processing section 34 can output image data D2 that is closer to the ideal characteristic C1.

FIG. 6 explains, by way of example, that characteristic of the corrected image data D2 which is obtained in cases where the image data D0 of the previous frame FR(k−1) is fixed to a certain value (32 gradation in FIG. 6) and where only the image data D of the current frame FR(k) is increased from the same value as the image data D0. However, as described below, it is generally true that "in case of a rise gradation transition, the modulation processing section 34 according to the present embodiment can output image data D2 that is closer to the ideal characteristic C1 than is image data D2 outputted by the arrangement of Comparative Example 2". Note that the case of a rise gradation transition refers to a case where a gradation transition causes an increase in luminance, and to a case where the image data D of the current frame FR(k) is larger than the image data D0 of the previous frame FR(k−1) (more accurately, the luminance indicated by the image data D is greater the luminance indicated by the image data D0).

That is, the pixel array 2 according to the present embodiment is a liquid crystal display panel in which, generally, an increase in gradation difference causes an increase in torque that needs to be given to the liquid crystal molecules for response, or in torque that is to be given to the liquid crystal molecules at a time of response. Therefore, an increase in travel distance causes a reduction in response time to be observed. As a result, in the case of the arrangement in which the modulation processing section 34 generates the image data D2 by linear interpolation, a reduction in gradation difference causes a shortage of correction, and this tends to cause an increase in the ratio of the difference between the image data D2 generated by interpolation and the value of the ideal image data D2 to the amount of gradation transition.

In other words, in case of a rise gradation transition, no matter how the characteristic C1 of the ideal image data D2 with respect to the amount of gradation transition (E−S) is drawn in the same manner as in FIG. 6 while changing the combination of the image data D0 of the previous frame FR(k−1) and the image data D of the current frame FR(k), the characteristic C1 is an upward convex line in a range where the gradation transition needs to be emphasized.

As a result, on the assumption that, as in Comparative Example 2, linear interpolation is so performed in cases where no gradation transition occurs that the image data D of the current frame FR(k) can be outputted, it is only possible to output, in cases where the gradation transition needs to be emphasized, image data D2 that is always less than an ideal value.

On the other hand, as described above, if the modulation processing section 34 according to the present embodiment outputs a linearly interpolated value even in cases where no gradation transition occurs, it performs linear interpolation so as to be able to output a value that is greater than the image data D of the current frame FR(k). Therefore, the characteristic of the image data D2 outputted by the modulation processing section 34 is like C4 shown in FIG. 6, so that the modulation processing section 34 can output image data D2 that is closer to the ideal characteristic C1.

Here, the value V referred to when C4 is outputted is calculated, for example, in the following manner. Specifically, on the assumption that P1 is a point at which the amount of gradation transition is largest, that P2 is a point at which the amount of gradation transition is L, and that P3 is a point of intersection between (i) a straight line by which P1 and P2 are connected and (ii) a straight line of S=32 (such a straight line that the image data D is at the minimum value), the value V is a value represented by the image data D2 at P3. More preferably, P2 is selected to the extent that the amount of correction within a correction zone does not exceed the ideal value (i.e., that no overcorrection is made).

The modulation processing section 34 performs linear interpolation according to the foregoing setting. Therefore, if a linearly interpolated value is outputted even in cases where no gradation transition occurs, a value that is greater than the image data D is outputted. In this case, when there is no gradation transition, e.g., when a still image is displayed, the luminance of a pixel PIX cannot be controlled so as to be a correct luminance (luminance indicated by the image data D of the current frame FR(k)). This causes deterioration in display quality of the image display apparatus 1.

However, in cases where the amount of gradation transition (S−E) is smaller than the predetermined threshold value L, the modulation processing section 34 according to the present embodiment does not emphasize the gradation transition, but outputs the image data D of the current frame FR(k). Therefore, even when the modulation processing section 34 performs linear interpolation according to the foregoing setting, the image display apparatus 1 can display a still image while so controlling the luminance of a pixel without any problem that it becomes a correct luminance. This makes it possible to prevent deterioration in display quality.

The foregoing description explains a case of a rise gradation transition. However, the same is equally true of a case of a decay gradation transition, albeit according to a difference principle. That is, in case of decay, an increase in gradation difference causes an increase in torque that needs to be given to the liquid crystal molecules for response based on a relaxation of an elastic body, on in torque that is to be given to the liquid crystal molecules at a time of response based on a relaxation of an elastic body. Therefore, an increase in travel distance causes an increase in response time of the liquid crystal molecules. In cases where the amount of correction is constant, the response time can be further shortened.

Similarly, an increase in gradation difference causes an increase in torque that needs to be given to the liquid crystal molecules for response, on in torque that is to be given to the liquid crystal molecules at a time of response. Therefore, an increase in travel distance causes a reduction in response time to be observed.

As a result, in the case of the arrangement in which the modulation processing section 34 generates the image data D2 by linear interpolation, a reduction in gradation difference causes a shortage of correction, and this tends to cause an increase in the ratio of the difference between the image data D2 generated by interpolation and the value of the ideal image data D2 to the amount of gradation transition.

Therefore, in case of a decay gradation transition, no matter how the characteristic C1 of the ideal image data D2 with respect to the amount of gradation transition (E−S) is drawn in the same manner as in FIG. 6 while changing the combination of the image data D0 of the previous frame FR(k−1) and the image data D of the current frame FR(k), the characteristic C1 is a downward convex line in a range where gradation transition needs to be emphasized.

As a result, on the assumption that, as is Comparative Example 2, linear interpolation is so performed in cases where no gradation transition occurs that the image data D of the current frame FR(k) can be outputted, it is only possible to output, in cases where the gradation transition needs to be emphasized, the image data D2 that is always greater than an ideal value.

However, as in the present embodiment, in cases where a homeotropic-mode liquid-crystal cell is used in a normally black mode, a response characteristic with respect to a decay-direction gradation transition is less affected by a level of the amount of gradation transition than a response characteristic with respect to a rise-direction gradation transition, so that the aforementioned shortage of correction is not great.

Further, especially in cases where a homeotropic-mode liquid-crystal cell is used in a normally black mode, a rise-direction response characteristic is easily affected by the amount of gradation transition. Furthermore, especially in case of a gradation transition starting from 0 gradation, a response is very slow, so that a large amount of correction is required (there is a large difference between uncorrected image data D and corrected image data D2).

Therefore, as compared with the following arrangement in which not only a value for highly precisely correcting image data D that is in gradation transition in a rise direction but also a value for highly precisely correcting image data D that is in gradation transition in a decay direction are stored in the LUT 35, it is possible to reduce circuit size without causing great deterioration in display quality.

[Embodiment 2]

In the present embodiment, an arrangement in which the aforementioned shortage of correction is inhibited from being caused in a decay-direction gradation transition as well as a rise-direction gradation transition.

That is, as shown in FIG. 1, a modulation driving processing section 21*a* according to the present embodiment is arranged in substantially the same manner as the modulation driving processing section 21 of Embodiment 1, but is provided with a modulation processing section 34*a* and an LUT 35*a* instead of the modulation processing section 34 and the LUT 35.

The LUT 35*a* is substantially identical to the LUT 35 shown in FIG. 5. However, as shown in FIG. 7, not only a value V1 for emphasizing a rise-direction gradation transition but also a value V2 for emphasizing a decay-direction gradation transition are stored in the LUT 35*a* in correspondence with a combination by which no gradation transition is caused. Note that these values V1 and V2 correspond to first and second parameters recited in CLAIMS, respectively.

Here, the value V2 for use in a decay direction indicates a value that is less than image data D2=D0=D. On the assumption that P1 is a point at which the amount of gradation transition is largest, that P2 is a point at which the amount of gradation transition is L, and that P3 is a point of a line, by which P1 and P2 are connected, at which point the image data D is smallest, the value V2 is a value that the image data D2 has at P3. As with a method used in case of a rise, P2 is preferably selected so that the amount of correction within a correction zone is closest to the ideal value to the extent that it does not exceed the ideal value (i.e., the correction value does not fall short of the ideal value, because this is a case of decay).

Further, the modulation processing section 34*a* is substantially identical to the modulation processing section 34. However, in cases where a value corresponding to a combination by which no gradation transition is caused is read out from the LUT 35*a*, whether the gradation transition is in a rise direction or in a decay direction is determined in accordance with the image data D of the current frame FR(k) and the image data D0 of the previous frame FR(k−1). In cases where the gradation transition is in a decay direction, the value V2 for use in a decay direction can be read from among the two values V1 and V2 so stored in the LUT 35*a* as to correspond to the combination. On the other hand, in cases where the gradation transition is in a rise direction, the value V1 for use in a rise direction can be read from among the two values V1 and V2.

Here, the values V1 and V2 may be stored as they are. However, in the present embodiment, in order to achieve a reduction in storage capacity, the values V1 and V2 are stored in the form of a difference value corresponding to the image data D of the current frame FR(k) (or the image data D0 of the previous frame FR(k−1)). The undifferentiated values V1 and V2 can be restored by adding or subtracting, to or from the image data D (or D0), a value V1*a* or V2*a* read out from the LUT 35.

As with Embodiment 1, the present embodiment makes it possible to inhibit a shortage of correction from being caused in a rise-direction gradation transition. As well, the present embodiment makes it possible to inhibit the aforementioned shortage of correction from being caused in a decay-direction gradation transition. Therefore, as compared with Comparative Example 2, the present embodiment makes it possible to output larger image data D2 that is closer to the ideal characteristic C1.

In the present embodiment, as with Embodiment 1, in cases where the amount of gradation transition falls short of the threshold value L, the modulation processing section 34*a* does not emphasize the gradation transition. This makes it possible to prevent display quality from deteriorating when a still image is displayed.

[Embodiment 3]

In the present embodiment, an arrangement in which the LUT 35 of Embodiment 1 or the LUT 35*a* of Embodiment 2 can be selected depending on the situation is explained with reference to FIG. 8. Note that examples of a trigger for changing a value (a degree of emphasis for gradation transition) to be stored in an LUT include various triggers such as temperature and the type (whether or not an image involves a lot of motions) of image to be displayed. However, the following explains a case where temperature from among these triggers serves as a trigger for switching between the LUTs.

More specifically, when the value V1*a* for use in a rise direction and the value V2*a* for use in a decay direction are stored in the LUT 35*a* as in Embodiment 2, it is possible to output image data D2 that is closer to the ideal characteristic C1. However, this imposes a limit on a range of each of the values V1*a* and V2*a* which range can be stored without causing an increase in memory capacity of the LUT 35*a*.

For example, in cases where the image data D0 and D are each expressed in 8 bits and where the LUT 35*a* is provided with an 8-bit storage region serving as a region in which a value corresponding to one combination of the image data D0 and D is stored, an attempt to store both the values V1*a* and V2*a* in the storage region imposes such a limitation that the size of the storage region that can be occupied by each of the values V1*a* and V2*a* is limited, for example, to 4 bits. Therefore, whereas a range of values that can be represented by a value V0 stored in the LUT 35*a* in correspondence with a combination by which a gradation transition is caused is a range of values (0 to 255) that can be expressed in 8 bits, a range of values that can be represented by the values V1*a* and V2*a* is limited to a range of values (0 to 16) that can be expressed in 4 bits.

Therefore, in cases where the amount of correction is large (in cases where the degree of emphasis for gradation transition is great), e.g., in cases where the temperature is relatively low, an attempt to store an appropriate value in the LUT 35*a* causes an increase in required memory capacity. This causes an increase in circuit size of the modulation driving processing section.

On the other hand, the modulation driving processing section according to the present embodiment uses the LUT 35 in cases where the amount of correction is large and where an attempt to store an appropriate value in the LUT 35*a* causes an increase in required memory capacity, and uses the LUT 35*a* in other cases. This makes it possible to prevent an increase in circuit size, and to output image data D2 that is closer to the ideal characteristic C1.

Specifically, in the modulation driving processing section according to the present embodiment, unlike in the arrangement in which the same LUT is used regardless of the temperature as in Embodiments 1 and 2, the temperature is divided into a plurality of temperature ranges, and the LUT to which the modulation processing section refers in emphasizing a gradation transition can be selected depending on which of the temperature ranges the current temperature falls within.

Figure 8:
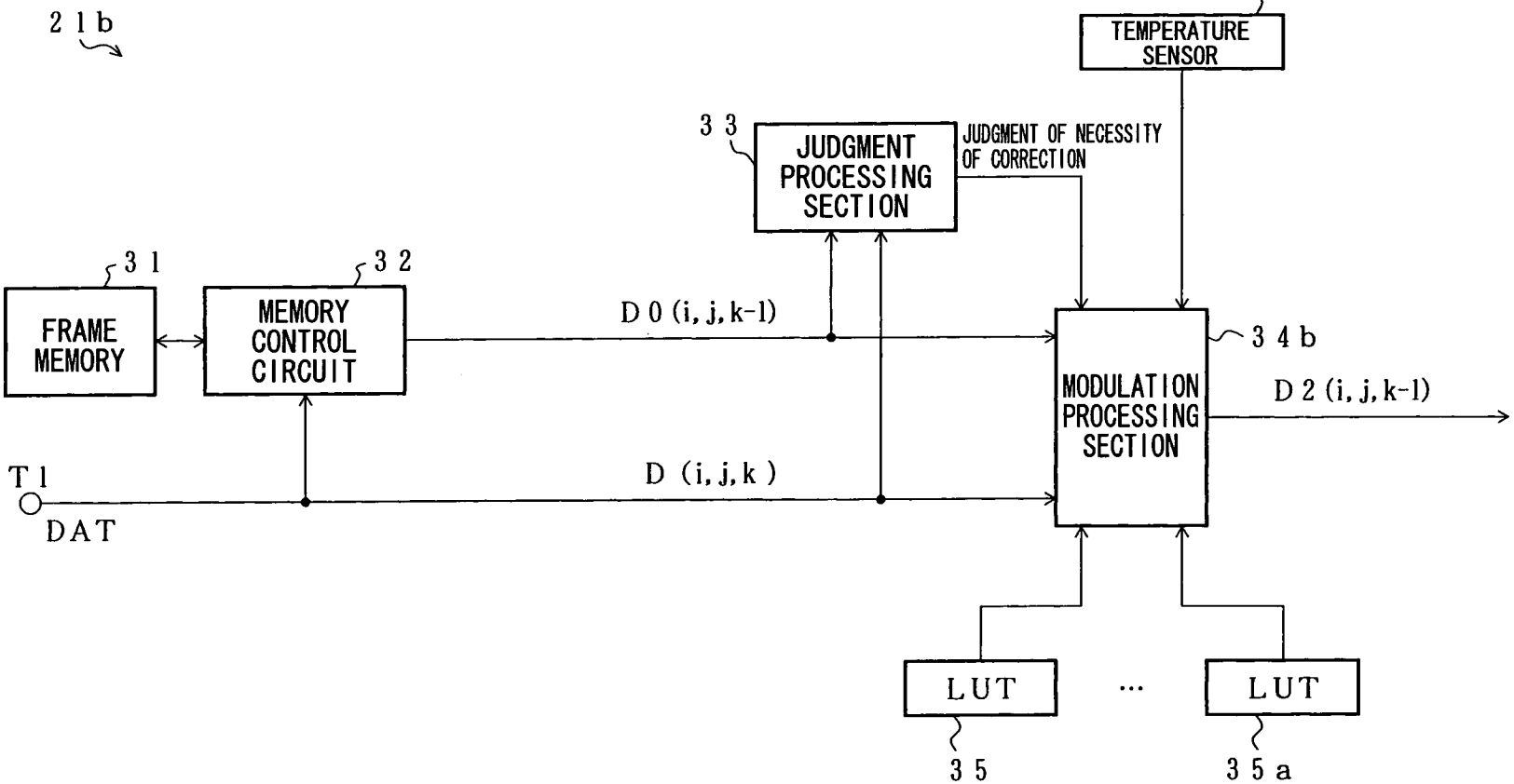
FIG. 8 shows another embodiment of the present invention, and is a block diagram showing a structure of a main part of a modulation driving processing section.
Figure 9:
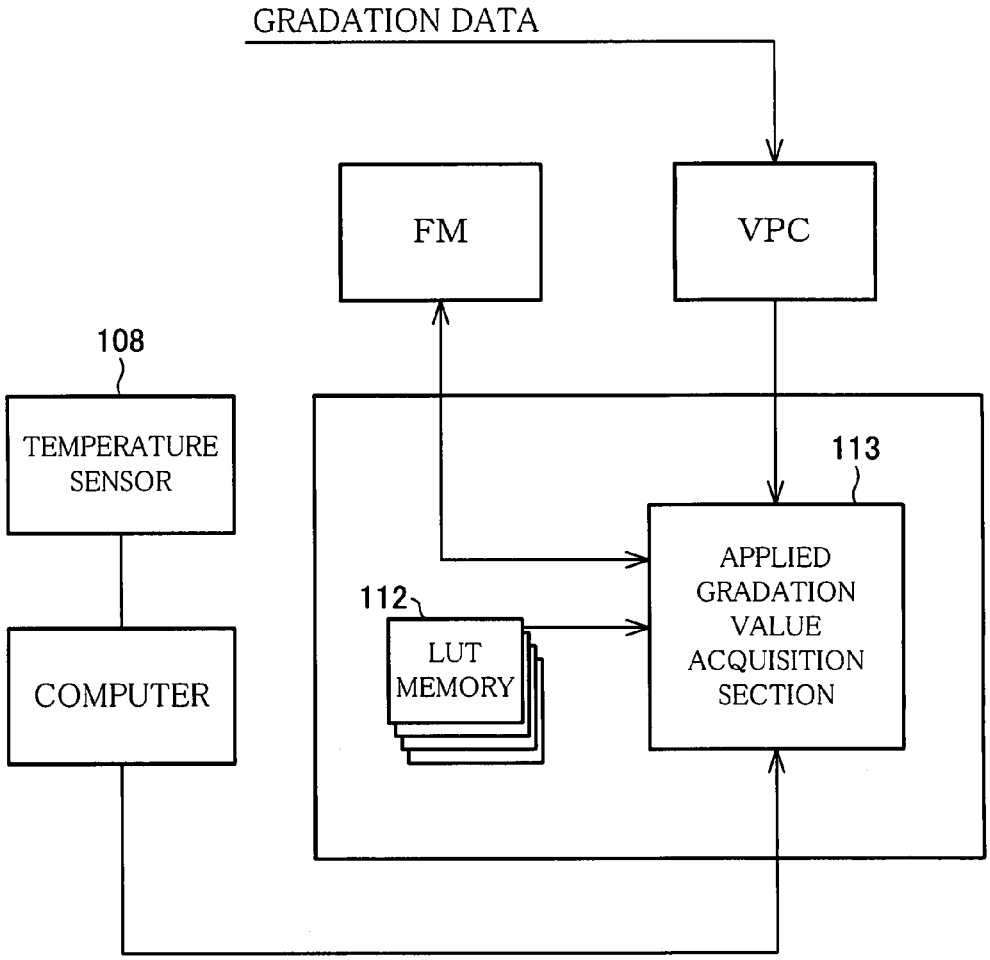
FIG. 9 shows a conventional technology, and is a block diagram showing a structure of a liquid crystal display apparatus.

More specifically, as shown in FIG. 8, a modulation driving processing section 21 according to the present embodiment is arranged in substantially the same manner as the modulation driving processing section 21 according to Embodiment 1. However, the LUT 35 is replaced by a LUT group 37 including LUTs respectively corresponding to the temperature ranges. Each of the LUTs constituting the LUT group 37 is either an LUT 35 or an LUT 35*a*. The respective numbers of LUTs 35 and LUT 35*a* can be each set to any number. However, some of the LUTs are LUTs 35, and the rest of the LUTs are LUT 35*a*. In the present embodiment, the LUT 35 corresponds to the following temperature range T1, i.e., a temperature range T2 in which the amount of correction is large and in which an attempt to store an appropriate value in the LUT 35*a* causes an increase in required memory capacity, and the LUT 35*a* corresponds to other temperature ranges.

Further, in addition to the arrangement of the modulation driving processing section 21, the modulation driving processing section 21*b* according to the present embodiment is provided with a temperature sensor 36 for detecting the temperature of the panel 11 shown in FIG. 2. The temperature sensor 36 may be disposed in any position as long as it can detect/infer the temperature of a pixel PIX. However, in order not to affect a display and in order to more accurately detect/infer the temperature of the pixel PIX, the temperature sensor 36 is preferably provided on a non-display region of a substrate on which a pixel electrode of the pixel PIX is provided, of a substrate facing the substrate, or of a color filter.

Furthermore, a modulation processing section 34*b* provided instead of the modulation processing section 34 can select, in accordance with a result of detection carried out by the temperature sensor 36, that one of the LUTs (35, 35*a*, . . . ) which is currently referred to at a time of emphasizing a gradation transition, and can output corrected image data D2 in accordance with a value stored in the LUT.

Further, in cases where the selected LUT is an LUT 35*a*, the modulation processing section 34*b* can output image data D2 by operating in the same manner as the modulation processing section 34*a* of Embodiment 2. Meanwhile, in cases where the selected LUT is an LUT 35, the modulation processing section 34*b* can output image data D2 by operating in the same manner as the modulation processing section 34 of Embodiment 1.

According to the foregoing arrangement, in cases where the result of detection carried out by the temperature sensor 36 indicates the temperature range T1, the modulation processing section 34*b* refers to an LUT 35, and generates corrected image data D2. Therefore, unlike in cases where all the LUTs are LUTs 35*a*, even in such a temperature range that the amount of correction is large and that an attempt to store an appropriate value in the LUT 35*a* causes an increase in required memory capacity, it is possible to prevent an increase in memory capacity required for an LUT, and to inhibit a shortage of correction from being caused at a time of a rise-direction gradation transition. On the other hand, according to the present embodiment, at least one of the LUTs is an LUT 35*a*. Therefore, as compared with a case where all the LUTs are LUTs 35, it is possible to output image data D2 that is closer to the ideal characteristic C1. This makes it possible to prevent a great increase in circuit size, to output image data D2 that is closer to the ideal characteristic C1, and to improve display quality.

Each of the embodiments explains a case where a homeotropic-mode and normally-black-mode liquid-crystal cell is used as a display element. However, the present invention is not limited to this. According to an ordinary liquid crystal display apparatus, an increase in gradation difference causes an increase in torque that needs to be given to the liquid crystal molecules for response, or in torque to be given to the liquid crystal molecule at a time of response, and an increase in travel distance causes a reduction in response time to be observed. Therefore, in cases where the modulation processing section generates the image data by linear interpolation, a reduction in gradation difference causes a shortage of correction, and this tends to cause an increase in the ratio of the difference between the image data D2 generated by interpolation and the value of the ideal image data D2 to the amount of gradation transition. As a result, any liquid crystal display apparatus can bring about the same effects as those of each of the embodiments.

Further, a display element other than a liquid crystal display element can bring about substantially the same effects as long as it is a display element in which a large correction is required because of a relatively low response speed of a pixel and in which a correction value (a difference between the value of the pre-correction image data D and the value of the corrected image data D2) is greatly changed depending on the amount of gradation transition.

Each of the embodiments explains a case where members constituting the modulation driving processing section are realized by using hardware alone. However, the present invention is not limited to this. All or part of the members may be realized by using a combination of (i) a program for realizing the aforementioned functions and (ii) hardware (a computer) for executing the program. For example, the modulation driving processing section (21 to 21*b*) may be realized such that a computer connected to the image display apparatus 1 serves as a device driver to be used in driving the image display apparatus. Further, see a case where the modulation driving processing section is realized as a conversion substrate that is to be built in or externally attached to the image display apparatus 1 and a rewriting of a program such as firmware allows for change in operation of a circuit that realizes the modulation driving processing section. In this case, the hardware may be operated as the modulation driving processing section of each of the embodiments by (a) distributing the software by distributing a recording medium storing the software or by transmitting the software via a communication path, and by (b) causing the hardware to execute the software.

In these cases, as long as hardware capable of executing the aforementioned functions is prepared, the modulation driving processing section according to each of the embodiments can be realized only by causing the hardware to execute the program.

More specifically, the modulation driving processing section (21 to 21*b*) according to each of the embodiments is realized by using software in the following manner. That is, calculating means including a CPU or hardware capable of executing the aforementioned functions executes a program code stored in a storage device such as a ROM or a RAM, and controls peripheral circuits such as input-output circuits (not shown).

In this case, the signal processing section can be realized by using a combination of (i) hardware for performing part of processing and (ii) the calculating means for controlling the hardware and for executing the program code for performing the rest of the processing. Furthermore, among the members, even a member explained as hardware can be realized by using a combination of (i) hardware for performing part of processing and (ii) the calculating means for controlling the hardware and for executing the program code for performing the rest of the processing. Further, the calculating means may be made up of a single processor or the like. Alternatively, the calculating means may be made up of a plurality of processors or the like that are so connected to one another via buses or channels inside the apparatus as to execute the program code together.

A program such as (i) the program code which can be executed directly by the calculating means or (ii) a program that is data from which the program code can be generated by carrying out a process such as decompression (will be described later) is (a) distributed by storing this program (the program code or the data) in a storage medium, or (b) distributed by transmitting the program using communication means for transmitting the program via a wired or wireless communication path. Then the program is executed by the calculating means.

In the case of transmitting the program via the communication path, a signal string indicating the program is transmitted via transmission media constituting the communication path, that is, the signal string is transmitted from one transmission medium to another. In this way, the program is transmitted via the communication path. Further, when transmitting the signal string indicating the program, the signal string may be superimposed on a carrier wave by causing the transmitting apparatus to modulate the carrier wave with the use of the signal string. In this case, the receiving apparatus demodulates the carrier wave so as to restore the signal string. On the other hand, when transmitting the signal string, the transmitting apparatus may (i) divide the signal string that is a digital data string into packets and (ii) transmit the packets. In this case, the receiving apparatus links received packets with each other so as to restore the signal string. Further, when transmitting the signal string, the transmitting apparatus may (i) combine the signal string with another signal string using a method such as time division, frequency division, or code division, and (ii) transmit the combined signal string. In this case, the receiving apparatus extracts the individual signal strings from the combined signal string so as to restore the signal strings. In either case, the same effect can be obtained as long as the program is transmitted via the communication path.

Here, the storage medium used for distributing the program is preferably detachable. However, a storage medium used for storing the distributed program may or may not be detachable. Further, as long as the storage medium stores the program, the storage medium may or may not be rewritalbe (writable) or volatile. Furthermore, the storage medium may store the program in any manner, and may have any shape. Examples of the storage medium are: (i) tapes such as a magnetic tape and a cassette tape; (ii) magnetic disks such as a Floppy® disk and a hard disk; (iii) disks such as a CD-ROM, a magnetic optical disk (MO), a mini disk (MD), and a digital video disk (DVD); (iv) cards such as an IC card and an optical card; (v) semiconductor memories such as a mask ROM, an EPROM, an EEPROM, and a flash ROM; and (vi) a memory provided in calculating means such as a CPU.

The program code may be a code for instructing the calculating means to carry out all steps of each of the foregoing processes. Alternatively, if there already exists a basic program (e.g., an operating system or a library) which can be started up in a predetermined manner and execute all or part of the steps, all or part of the steps may be substituted with the use of a code or pointer for instructing the calculating means to start up the basic program.

In addition, the program storage format of the storage medium may be, for example, such that: the calculating means can access the program for an execution as in an actual memory having loaded the program; the program is not loaded into an actual memory, but installed in a local storage medium (for example, an actual memory or hard disk) always accessible to the calculating means; or the program is stored before installing in a local storage medium from a network or a mobile storage medium. In addition, the program is not limited to compiled object code. The program may be stored as source code or intermediate code generated in the course of interpretation or compilation. In any case, the similar effects are obtained regardless of the format in which the storage medium stores the program, provided that decompression of compressed information, decoding of encoded information, interpretation, compilation, links, or loading to a memory or combinations of these processes can convert into a format executable by the calculating means.

As described above, an image data processing device (e.g., a signal processing section 21, 21*a*, or 21*b*) according to any one of the embodiments includes: an image data storage device (e.g., a frame memory 31) in which image data, being repeatedly inputted, which indicates a gradation of a pixel is stored until next image data; and correction means capable of outputting, in accordance with previous image data and current image data that has been read out from the image data storage section, corrected image data corrected so that a gradation transition from a gradation indicated by the previous image data to a gradation indicated by the current image data is emphasized, the correction means including: a parameter storage device (e.g., an LUT 35 or 35*a*) which, in correspondence with predetermined part of combinations of possible values of the previous image data and possible values of the current image data, contains parameters for determining corrected image data corresponding to the predetermined combinations, respectively; and interpolation means (e.g., a modulation processing section 34, 34*a*, or 34*b*) (i) for, when a difference between the gradations respectively indicated by the previous and current image data inputted thereto is more than a predetermined threshold value and when a parameter corresponding to an input combination of a value of the previous and a value of the current image data is not stored in the parameter storage device, (a) reading out a plurality of parameters from the parameter storage device, (b) calculating a parameter corresponding to the input combination by making an interpolation calculation that is based on the plurality of parameters, and (c) generating the corrected image data, and (ii) for outputting the current image data without correction when the difference between the gradations respectively indicated by the previous and current image data inputted thereto is not more than the threshold value, the parameter storage device containing, as a parameter corresponding to a specific one of the predetermined combinations which is constituted by values indicating an identical gradation, a parameter which is such that a gradation indicated by corrected image data determined by the parameter is neither of gradations respectively indicated by the values constituting the specific combination and by which a parameter corresponding to the specific combination is calculated according to the interpolation calculation and when a difference between gradations respectively indicated by the values constituting the input combination is more than the threshold value.

According to this arrangement, in cases where the difference between the gradations respectively indicated by the inputted image data is more than a predetermined threshold value, the image data processing device can output corrected image data by which the gradation transition is emphasized. This makes it possible to improve the response speed of a pixel of a display apparatus by which image data is displayed.

Further, in cases where the amount of gradation transition is not more than the threshold value, the correction means does not emphasize the gradation transition. This makes it possible to prevent the following problem: In case where a still image is displayed, a slight gradation transition occurring due to the influence of noise or the like is emphasized, so that an undesired gradation transition is seen by the user.

Furthermore, the parameter storage device contains only parameters corresponding to part of combinations of respective possible values of the current and previous image data, and parameters corresponding to the rest of the combinations are calculated by interpolation calculation. This makes it possible to achieve a larger reduction in circuit size than when the parameter storage device contains parameters corresponding to all the combinations.

Further, the parameter storage device contains a parameter in correspondence with the specific combination, i.e., a parameter which is such that a gradation indicated by corrected image data determined by the parameter is neither of gradations indicated by the values constituting the specific combination and by which a parameter corresponding to the specific combination is calculated according to the interpolation calculation and when a difference between gradations respectively indicated by the values constituting the input combination is more than the threshold value. Therefore, as compared with an arrangement in which either of the gradations respectively indicated by the values constituting the specific combination is stored in correspondence with the specific combination by which no gradation transition occurs, it is possible to achieve a reduction in error attributed to an approximation made with the use of interpolation calculation, and to improve the quality of a display carried out by a display apparatus.

This makes it possible to realize a display apparatus that is balanced between a reduction in circuit size and an improvement in display quality at a higher level.

In cases where such a parameter is stored in correspondence with the specific combination, the use of interpolation calculation at the time when the amount of gradation transition is not more than the threshold value may cause an increase in error attributed to an approximation made with the use of interpolation calculation. However, the correction means does not emphasize the gradation transition in cases where the amount of gradation transition is not more than the threshold value. Therefore, no such error occurs in cases where the amount of gradation transition is not more than the threshold value. This makes it possible to prevent display quality from deteriorating due to such an error.

Further, in addition to the foregoing arrangement, the image data processing device may be arranged such that: the parameter storage device includes, as a parameter corresponding to the specific combination, a first parameter that is to be read out when a second gradation indicated by the inputted current image data is brighter than a first gradation indicated by the inputted previous image data and a second parameter that is to be read out when the second gradation indicated by the inputted current image data is darker than the first gradation indicated by the inputted previous image data; and in reading out a parameter corresponding to the specific combination from the parameter storage device, the interpolation means reads out the first parameter when the second gradation is brighter than the first gradation, and reads out the second parameter when the second gradation is darker than the first gradation.

According to this arrangement, two parameters are stored in correspondence with the specific combination. Therefore, in case of both a gradation transition in which the luminance of a pixel increases and a gradation transition in which the luminance of a pixel decreases, it is possible to achieve a reduction in error attributed to an approximation made with the use of interpolation calculation, and to improve the quality of a display carried out be a display apparatus, as compared with an arrangement in which either of the gradations respectively indicated by the values constituting the specific combination is stored in correspondence with the specific combination by which no gradation transition is caused.

Furthermore, in addition to the foregoing arrangement, the image data processing device may be arranged such that: each of the parameters indicates a gradation of the corrected image data; and each of the first and second parameters indicates a difference between the gradation indicated by the current image data and the gradation indicated by the corrected image data which gradation serves as the parameter; and when the interpolation means has read out the first or second parameter, the interpolation means restores, in accordance with the first or second parameter and the current image data, the parameter corresponding to the specific combination.

According to this arrangement, each of the parameters indicates a gradation of the corrected image data, and each of the first and second parameters is stored as a difference value. Here, in cases where the first and second parameters are stored, i.e., in cases where only a slight amount of gradation transition occurs, the difference between the corrected image data and the current and previous image data is smaller than in other cases where a larger amount of gradation transition occurs. Therefore, by storing the corrected image data and a parameter indicative of the difference between the corrected image data and the previous or current image data instead of a parameter indicative of the corrected image data, the size of memory capacity necessary for storing the first and second parameters can be reduced. As a result, as compared with a case where the corrected image data is directly stored as the first and second parameters, the circuit size of an image data processing device can be reduced.

Meanwhile, in addition to the foregoing arrangement, the image data processing device according to the present invention is arranged such that: each of the parameters indicates a gradation of the corrected image data; and the parameter storage device contains, as a parameter corresponding to the specific combination, a parameter that is to be read out in a predetermined one of a case where a second gradation indicated by the inputted current image data is brighter than a first gradation indicated by the inputted previous image data and a case where the second gradation indicated by the inputted current image data is darker than the first gradation indicated by the inputted previous image data; and in acquiring a parameter corresponding to the specific combination, the interpolation means reads out the parameter from the parameter storage device in the predetermined case, and otherwise uses the current image data as the parameter corresponding to the specific combination.

According to this arrangement, in an unchosen one of the case where the second gradation indicated by the inputted current image data is brighter than the first gradation indicated by the inputted previous image data and the case where the second gradation indicated by the inputted current image data is darker than the first gradation indicated by the inputted previous image data, the current image data is used as a parameter corresponding to the specific combination. Therefore, a parameter appropriate for one of the cases is different from a parameter appropriate for the other. Even when the use of one of the parameters as the other causes display quality to be lower than in cases where a value indicative of the current image data is used as a parameter, the degree of deterioration in display quality can be maintained in the same manner as in the following arrangement in which either of the gradations respectively indicated by the values constituting the specific combination is stored in correspondence with the specific combination by which no gradation transition occurs. This makes it possible to improve display quality in one of the cases while inhibiting display quality from deteriorating in the other one of the cases.

Further, as described above, a display apparatus driving device (e.g., an image display apparatus 1, 1*a*, or 1*b*) according to any one of the embodiments is a display apparatus driving device, including: correction means (e.g., a signal processing section 21, 21*a*, or 21*b*) for correcting image data, being inputted repeatedly, which indicates a gradation of a pixel, and for outputting the image data thus corrected; and output means (e.g., a data signal line driving circuit 3) for outputting, to a data signal line connected to the pixel, a signal corresponding to the image data thus corrected, the uncorrected image data being inputted repeatedly being D(n−1) and D(n), the corrected image data respectively corresponding to the uncorrected image data being D2(*n*−1) and D2(*n*), when an amount of gradation transition of the uncorrected image data is greater than a predetermined threshold value L, the correction means outputting D2(*n*)=a+k~[D(n−1)−D(n)] as the corrected image data D2(*n*), when the amount of gradation transition of the uncorrected image data is less than the threshold value L, the correction means outputting D2(*n*)=D(n) as the corrected data D2(*n*), a being set to be a value that is different from D(n).

According to this arrangement, D2(*n*)=a+k·[D(n−1)−D(n)] is outputted as the corrected image data D2(*n*) when the amount of gradation transition of the uncorrected image data is greater than a predetermined threshold value L, and D2(*n*)=D(n) is outputted as the corrected image data D2(*n*) when the amount of gradation transition is less than the threshold value L. Further, a is set to be a value that is different from D(n).

Therefore, as with the image data processing device, it is possible to achieve a reduction in error attributed to an approximation made with the use of interpolation calculation, and to improve the quality of a display carried out be a display apparatus, as compared with an arrangement in which either of the gradations respectively indicated by the values constituting the specific combination is stored in correspondence with the specific combination by which no gradation transition occurs. This makes it possible to realize a display apparatus that is balanced between a reduction in circuit size and an improvement in display quality at a higher level.

Furthermore, a liquid crystal display apparatus (e.g., an image display apparatus 1, 1*a*, or 1*b*) according to any one of the embodiments is characterized by including: an image data processing device of any one of the foregoing arrangements; and a liquid crystal display panel (e.g., a panel 11) that is driven in accordance with corrected image data sent from the image data processing device. Therefore, as with the image data processing device, it is possible to improve display quality without causing a great increase in circuit size, and to realize a liquid crystal display apparatus that is more highly balanced between a reduction in circuit size and an improvement in display quality.

Further, in addition to the foregoing arrangement, the liquid crystal display apparatus may be a television receiver or a liquid crystal monitor apparatus. As described above, a liquid crystal display apparatus having the image data processing device can achieve a balance between a reduction in circuit size and an improvement in display quality at a higher level, and therefore can be applied to a television receiver or a liquid crystal monitor apparatus.

The image data processing device may be realized by hardware, or may be realized by causing a computer to execute a program. Specifically, a program according to the present invention is a program for causing a computer having each storage device constituting any one of the foregoing image data processing devices to operate as each means constituting the image data processing device, and the program is stored in a storage medium according to the present invention.

When these programs are executed by a computer, the computer operates as the image data processing device. Therefore, as with the image data processing device, it is possible to improve display quality without causing a great increase in circuit size, and to realize a liquid crystal display apparatus that is more highly balanced between a reduction in circuit size and an improvement in display quality.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

The present invention does not cause a great increase in circuit size, and makes it possible to reduce an error attributed to an approximation made by interpolation calculation in cases where there is almost no gradation transition. Therefore, the present invention makes it possible to realize a display apparatus that is balanced between a reduction in circuit size and an improvement in display quality at a higher level. As such, the present invention can be used widely as (i) an image data processing device to be provided in a television receiver or in a liquid crystal monitor apparatus and (ii) an image data processing device for use in various display apparatuses.

The invention claimed is:

1. An image data processing device, comprising:

an image data storage device in which image data, being repeatedly inputted, which indicates a gradation of a pixel is stored until next image data; and a correction means configured to output, in accordance with previous image data and current image data that has been read out from an image data storage section, corrected image data based on a gradation transition from a gradation indicated by the previous image data to a gradation indicated by the current image data, the correction means including:

a parameter storage device configured to store a plurality of first calculation parameters for determining the corrected image data based on combinations of values associated with the previous image data and values associated with the current image data, the values being used to calculate gradations; and interpolation means (i) for, when a difference between the gradations respectively indicated by the previous image data and the current image data inputted thereto is more than a threshold value and when a second calculation parameter is not stored in the parameter storage device, the second calculation parameter corresponds to an input combination of a value of the previous image data and a value of the current image data, (i-a) reading out the plurality of first calculation parameters from the parameter storage device, (i-b) calculating the second calculation parameter by making an interpolation calculation based on the plurality of first calculation parameters, and (i-c) generating the corrected image data, and (ii) for outputting the current image data without correction when the difference between the gradations respectively indicated by the previous image data and the current image data inputted thereto is not more than the threshold value, the parameter storage device stores a third calculation parameter corresponding to one of the combinations of values used to calculate gradations including values indicating an identical gradation, a fourth calculation parameter corresponding to a gradation indicated by corrected image data that is not associated with the third calculation parameter, and a fifth calculation parameter calculated based on the interpolation calculation if a difference between gradations indicated by the values of the input combination is more than the threshold value, the fifth calculation parameter being associated with a same combination of values as the third calculation parameter.

2. The image data processing device as set forth in claim 1, wherein: the parameter storage device stores, a first parameter that is to be read out when a second gradation indicated by the inputted current image data is brighter than a first gradation indicated by the inputted previous image data, and a second parameter that is to be read out when the second gradation indicated by the inputted current image data is darker than the first gradation indicated by the inputted previous image data; and the interpolation means reads out the first parameter when the second gradation is brighter than the first gradation, and reads out the second parameter when the second gradation is darker than the first gradation.

3. The image data processing device as set forth in claim 2, wherein: each of the first through fifth calculation parameters indicates a gradation of the corrected image data; and each of the first and second parameters indicates a difference between the gradation indicated by the current image data and the gradation indicated by the corrected image data; and when the interpolation means reads out the first or second parameter, the interpolation means restores the one of the combinations of values based on the first or second parameter and the current image data.

4. The image data processing device as set forth in claim 1, wherein: each of the first through fifth calculation parameters indicates a gradation of the corrected image data; and the parameter storage device stores a sixth calculation parameter to be read out one of if a second gradation indicated by the inputted current image data is brighter than a first gradation indicated by the inputted previous image data and if the second gradation indicated by the inputted current image data is darker than the first gradation indicated by the inputted previous image data; and in acquiring the sixth calculation parameter, the interpolation means reads out the sixth calculation parameter from the parameter storage device, and otherwise uses the current image data as the sixth calculation parameter.

5. A liquid crystal display apparatus, comprising:

the image data processing device as set forth in claim 1; and a liquid crystal display panel that is driven in accordance with the corrected image data received from the image data processing device.

6. The liquid crystal display apparatus as set forth in claim 5, wherein the liquid crystal display apparatus is a liquid crystal television receiver or a liquid crystal monitor apparatus.

7. A computer program product comprising a non-transitory computer readable medium including a program segment for, when executed on a computer device causing the computer to implement the method of claim 1.

8. A non-transitory computer-readable storage medium in which the program segments as set forth in claim 7 are stored.

* * * * *